United States Patent [19]

Shirley

[11] Patent Number: 4,720,371

[45] Date of Patent: Jan. 19, 1988

[54] ROTARY DRILL BITS

[75] Inventor: David Shirley, Cheltenham, England

[73] Assignee: NL Petroleum Products Limited, Gloucestershire, England

[21] Appl. No.: 854,178

[22] Filed: Apr. 21, 1986

[30] Foreign Application Priority Data

Apr. 25, 1985 [GB] United Kingdom ..... 8510494

[51] Int. Cl.[4] ..... B22F 7/06; B22F 3/26

[52] U.S. Cl. ..... 419/10; 419/8; 419/13; 419/27

[58] Field of Search ..... 419/5, 8, 10, 12, 13, 419/27; 175/327; 428/457, 550, 552

[56] References Cited

U.S. PATENT DOCUMENTS

| | | | |
|---|---|---|---|
| 2,941,288 | 6/1960 | Whitehouse | 419/27 |
| 3,818,521 | 6/1974 | Vartanian et al. | 419/27 |
| 3,992,202 | 11/1976 | Dulis et al. | 419/5 |
| 4,145,798 | 3/1979 | Sarnes | 29/148.4 R |
| 4,214,906 | 7/1980 | Langer et al. | 75/208 R |
| 4,378,247 | 3/1983 | Tsoutsas | 419/5 |

OTHER PUBLICATIONS

"MPR", Jun. 1984, pp. 329–334, (vol. 39, No. 6).

Tabeshfar et al., "Powder Metallurgy" 1984, vol. 27, No. 11, p. 19–24.

*Primary Examiner*—John F. Terapane
*Assistant Examiner*—Eric Jorgensen
*Attorney, Agent, or Firm*—Browning, Bushman, Zamecki & Anderson

[57] ABSTRACT

A method of manufacturing by a powder metallurgy process a rotary drill bit including a bit body having an external surface on which cutting elements are mounted, and a passage for supplying drilling fluid to the surface of the bit. The method comprises forming a hollow mould for moulding at least a portion of the bit body, packing at least part of the mould with powdered matrix material, and infiltrating the material with a metal alloy in a furnace to form a matrix. Before the mould is packed with the powdered material, formers are positioned on the interior surface of the mould to project into the interior of the mould space and form sockets to receive nozzles, or studs on which the cutting elements are mounted. According to the invention, the formers are formed from material, such as austenitic stainless steel, having a coefficient of thermal expansion not less than that of the matrix material. The formers may have a surface coating of a ceramic, such as boron nitride, or other material which does not wet or react with the binder alloy or matrix material.

15 Claims, 3 Drawing Figures

ROTARY DRILL BITS

BACKGROUND OF THE INVENTION

The invention relates to rotary drill bits for use in drilling or coring deep holes in subsurface formations and, in particular, to methods of manufacturing such bits.

Rotary drill bits of the kind to which the invention relates comprise a bit body having a shank for connection to a drill string and a passage for supplying drilling fluid to the face of the bit. The bit body carries a plurality of cutting elements. Each cutting element may comprise a preform, often circular, having a thin superhard facing layer, which defines the front cutting face of the element, bonded to a less hard backing layer. For example, the superhard facing layer may be formed of polycrystalline diamond or other superhard material, and the backing layer may be formed of cemented tungsten carbide. The two-layer arrangement of the cutting elements provides a degree of self-sharpening since, in use, the less hard backing layer wears away more easily than the harder cutting layer. However, single layer preforms are also known and have the advantage that they may be more thermally stable.

In one type of drill bit of this basic kind, the cutting elements are mounted on the bit body by being bonded, for example, by brazing, to a carrier which may be in the form of a stud of tungsten carbide which is received and located in a socket in the bit body.

The bit body may be machined from steel or may be formed from a tungsten carbide matrix by a powder metallurgy process. In this process a hollow mould is first formed, for example from graphite, in the configuration of the bit body or a part thereof. The mould is packed with powdered material, such as tungsten carbide, which is then infiltrated with a metal binder alloy, such as a copper alloy, in a furnace so as to form a hard matrix. If the cutting elements are of a kind which are not thermally stable at the infiltration temperature, formers, conventionally of graphite, are normally mounted on the interior surface of the mould so as to define on the finished bit body locations where cutting elements may be subsequently located, for example sockets into which the studs on which the cutting elements are mounted may be secured. There may also be mounted on the interior surface of the mold formers which define, in the bit body, sockets to receive nozzles for delivering drilling fluid to the surface of the bit. The nozzle formers may be threaded so that the nozzle sockets are internally threaded to receive threaded nozzles.

Conventionally, the studs on which the cutting elements are mounted are secured within their respective sockets by brazing, press fitting or shrink fitting. While press fitting and shrink fitting are suitable for steel bit bodies where the sockets may be fairly accurately machined, difficulties arise in using such methods with a matrix body. For example, using graphite formers it is found that the dimensions of the sockets provided by the formers cannot be accurately controlled according to the tolerances necessary for press fitting or shrink fitting, with the result that studs may be inadequately secured within the sockets, or attempts to hammer or press a stud into an undersize socket may lead to cracking of the bit body or damage to the cutting structure.

Attempts have been made to overcome this problem by moulding the side walls of the sockets in a manner to give a textured surface so as to increase the permitted tolerances to give a satisfactory interference fit, but such methods have not proved entirely satisfactory. The problem has normally, therefore, been overcome as far as matrix bits are concerned by brazing the studs in the sockets, but it will be appreciated that this adds to the cost of manufacture of the bit. It may also be difficult to remove such brazed studs if it is delivered to repair the bit by replacing worn or damaged cutting structures.

Apart from the above-mentioned problem regarding the accuracy of sockets formed in a matrix bodied bit, difficulties may also arise in removing the formers from the bit body after the infiltration process has been completed.

In order to remove conventional formers, such as graphite formers, from the bit body it is normally necessary to remove them individually by destructive methods, usually involving drilling part of each former out and then mechanically scouring the residue from the socket. These processes are time consuming and expensive in labour costs.

The invention sets out to provide an improved method of forming sockets in a matrix bodied bit in which the above-mentioned problems may be reduced or overcome.

SUMMARY OF THE INVENTION

According to the invention there is provided a method of manufacturing by a powder metallurgy process a rotary drill bit including a bit body having an external surface on which are mounted a plurality of cutting elements, and a passage for supplying drilling fluid to the surface of the bit, the method including the steps of forming a hollow mould for moulding at least a portion of the bit body, packing at least part of the mould with powdered matrix material, and infiltrating the material with a metal alloy in a furnace to form a matrix, the method further including the step, before packing the mould with the powdered matrix material, of positioning on the interior surface of the mold at least one former which projects into the interior of the mould space at the desired location for a socket within the bit body, the former being formed from material having a coefficient of thermal expansion not less than that of the matrix material. Preferably the coefficient of thermal expansion of the former is significantly greater than that of the matrix material.

For example, the former may be of stainless steel, such as austenitic stainless steel.

Since the former has a coefficient of thermal expansion not less than that of the matrix material it will not be highly stressed during cooling of the matrix and subject to deformation, and accordingly, the socket which it forms in the matrix material may be formed with greater accuracy than a socket formed, for example, by use of a graphite former. Furthermore, the former may, if it is cylindrical and/or tapered, be bodily withdrawn from the socket after formation of the bit body thus avoiding the costs incurred in the time consuming process of removing graphite formers.

Due to the greater accuracy of the sockets, the carriers for the cutting elements may more readily be secured within the sockets by press fitting or shrink fitting without the carriers necessarily being brazed in addition, or without the necessity of the interior surfaces of the sockets being grossly textured.

Each former is preferably formed of material, at least at the outer surface thereof, which does not wet, or react with, the binder alloy used to infiltrate the matrix material. The former may be formed as a whole from such material, or may comprise a main body of material having a surface coating of such material.

In the case where the former has a surface coating, this may be in the form of a conventionally applied release agent, such as boron nitride, or may comprise a surface layer plated onto the main body of the former. In either case, the surface coating is such as to inhibit reaction between the binder alloy and the material of the main body of the former.

Where the surface layer is plated on, it is found that a plating of bronze (copper-tin alloy) or titanium nitride may be effective, for example in the case where the main body of the former is of stainless steel. In an alternative arrangement where the surface layer is plated on, the materials of the surface layer and of the main body of the former may be chosen such that the adherence of the surface coating material to the interior surface of the socket will be greater than the adherence of the surface coating material to the main body of the former. In this case, when the former is withdrawn from the bit body the surface coating will remain as a lining to the socket. The surface coating material may then be chosen so as to have desirable characteristics for such a lining. This arrangement is particularly suitable where the main body of the former is stainless steel since, as is well known, plating layers on stainless steel have a low level of adherence.

In any of the above arrangements each former is preferably provided with means for attachment of a tool whereby the former may be gripped to facilitate its removal from the finished bit body. For example, the former may be provided with an internally threaded bore into which a threaded portion of an extraction tool may be inserted, or it may be provided with an extension which projects from the finished bit body and which may be gripped by a suitable tool.

Where the formers are to provide sockets for carriers for cutting elements, the carriers and sockets will normally be cylindrical, for example of circular or rectangular cross section. However, other configurations are possible and the invention also provides an arrangement in which the socket and the carrier for the cutting element taper inwardly as they extend from the surface of the bit body. Such inward tapering may have several advantages.

Thus, where a cylindrical carrier and socket are used in a press fitting method, it is necessary to apply a substantial pressing force to the carrier during the whole of its insertion into the socket, whereas with a tapered carrier negligible force is required to insert the carrier most of the way into the socket and substantial force is required for only the last small distance of movement. During pressing of a cylindrical carrier into a socket scuffing of the surface of the carrier and/or the socket can occur if the elements have been inaccurately gauged, with the result that it may become impossible either to press the carrier fully home into the socket or to remove it. A tapered carrier can be simply gauged to its socket by inserting it as far as it will go into the socket without applying substantial force. The length of the carrier then projecting from the socket will be an accurate indication of the force required to press the carrier fully home. That is to say, if more than a predetermined length of carrier projects from the socket it will be obvious that the carrier is not sufficiently accurately matched to the socket.

Sockets may be diamond lapped to the required precise dimensions before press fitting a carrier and such diamond lapping is simpler where the socket is tapered since it does not require a radially expanding lapping tool.

In the case where the carrier is shrink fitted in the socket difficulties can also arise with cylindrical carriers and sockets. For example, as the carrier is introduced into the socket in the heated bit body it becomes heated itself and expands, and may thus become jammed part way in the socket causing difficulties in subsequent removal. This is less likely to occur with a tapered carrier and socket and, in any case, the tapering facilitates removal of the carrier from the bit body, if required.

Accordingly, the present invention includes arrangements in which the formers are tapered to provide tapered sockets in the finished bit body and it will be appreciated that such tapering also facilitates removal of the formers from the bit body after infiltration.

DETAILED DESCRIPTION OF THE PREFERRED EMBODIMENTS

Figure 1:
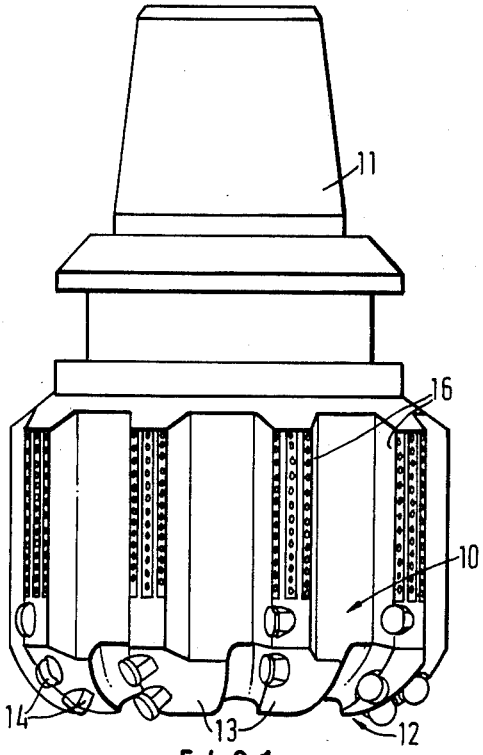
FIG. 1 is a side elevation of a typical drill bit of the kind to which the invention is applicable.
Figure 2:
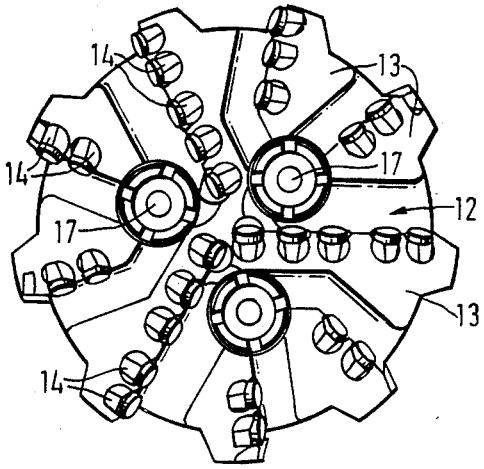
FIG. 2 is an end elevation of the drill bit shown in FIG. 1.

Referring to FIGS. 1 and 2, the body 10 of the drill bit is typically formed of tungsten carbide matrix infiltrated with a binder alloy, and has a threaded shank 11 at one end for connection to the drill string.

The operative end face 12 of the bit body is formed with a number of blades 13 radiating from the central area of the bit, and the blades carry cutting structures 14 spaced apart along the length thereof.

The bit has a gauge section including kickers 16 which contact the wall of the bore hole to stabilise the bit in the bore hole. A central passage (not shown) in the bit body and shank delivers drilling fluid through nozzles 17 in the end face 12 in known manner to clean and/or cool the cutting elements.

In the particular arrangement shown, each cutting structure 14 comprises a preform cutting element mounted on a carrier in the form of a stud which is located in a socket in the bit body. Conventionally, each preform cutting element is usually circular and comprises a thin facing layer of polycrystalline diamond bonded to a backing layer of tungsten carbide. However, it will be appreciated that this is only one example of the many possible variations of the type of bit to which the invention is applicable, including bits where each preform cutting element comprises a unitary layer of thermally stable polycrystalline diamond material.

Figure 3:
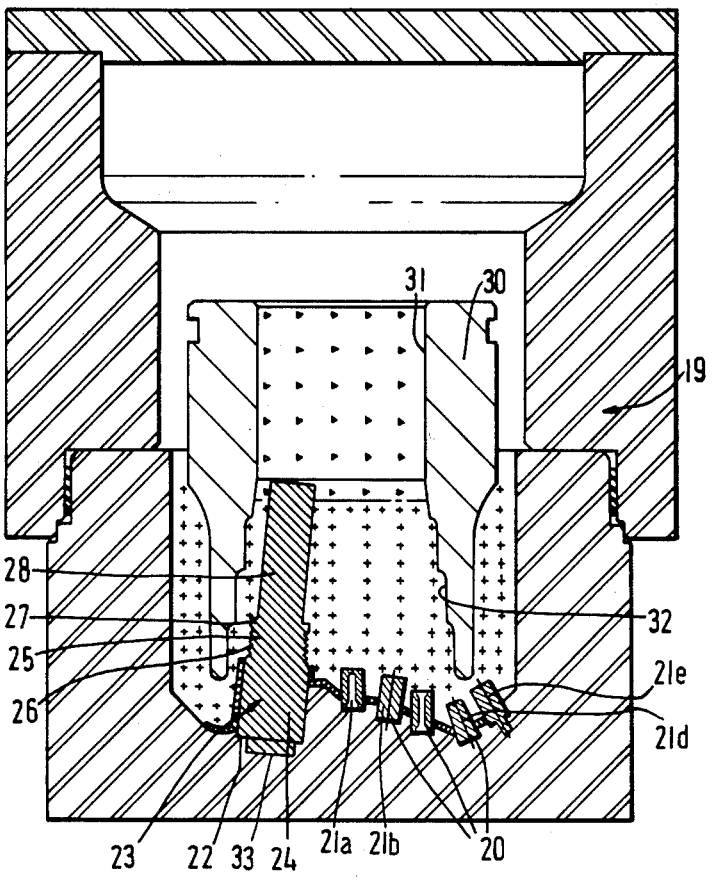
FIG. 3 is a vertical section through a mould showing the manufacture of a drill bit by the method according to the invention.

FIG. 3 illustrates a method of manufacturing a bit body of the kind shown in FIGS. 1 and 2. Referring to FIG. 3, a two part mould 19 is formed from graphite and has an internal configuration corresponding generally to the required surface shape of the bit body or a portion thereof. For example, the mould may be formed with elongate recesses corresponding to the blades 13. Spaced apart along each blade-forming recess are a plurality of sockets 20 each of which receives a cylindrical former 21*a*–21*e*, the object of the formers being to define in the matrix sockets to receive the studs on which the cutting elements are mounted. Accordingly, the formers are of the same cross sectional shape as the studs, for example circular (as shown) or rectangular. Alternatively, however, as previously mentioned the formers and studs may be tapered. The detailed construction of the formers will be described below.

The matrix material is moulded on and within a hollow steel blank 30. The blank is supported in the mould 19 so that its outer surface is spaced from the inner surface of the mould. The blank has an upper cylindrical internal cavity 31 communicating with a lower diverging cavity 32.

There is also provided in the mould 19, at each desired location for a nozzle 17, a socket 22 which receives one end of an elongate stepped cylindrical former 23 which extends into the mould space within the lower cavity 32 in the hollow steel blank 30. The former 23 comprises a first generally cylindrical portion 24, a second cylindrical portion 25 formed with an external screw thread 26, a third conically tapering portion 27 and a fourth elongate portion 28 of smaller diameter.

After the formers 21 and 23 are in position, and before the steel blank 30 is inserted, the bottom of the mould and the projecting part of the portion 24 of the former 23 may have applied thereto a layer of hard matrix-forming material to form a hard facing for the end face of the drill bit, and the cylindrical mouth of the nozzle socket.

The steel blank 30 is inserted into the mould and supported with its outer surface spaced from the inner surfaces of the mould. Powdered matrix forming material (for example, powdered tungsten carbide) is packed around the outside of the steel blank and within the lower diverging cavity 32 of the blank, and around the former 23 and the formers 21. Tungsten metal powder is then packed in the upper cavity 32 in the steel blank 30. The matrix forming material is then infiltrated with a suitable binder alloy in a furnace to form the matrix, in known manner.

After removal of the bit body from the mould, the formers 21 and 23 are removed from the bit body and the sockets so formed are then ready to receive the cutting structures 14 and nozzles 17 respectively.

Hitherto the formers 21 and 23 have conventionally been formed from graphite with the consequent disadvantages referred to earlier. According to the present invention, however, some or all of the formers are formed from material having a coefficient of thermal expansion not less than that of the matrix material. Each such former is also preferably formed, at least at the outer surface thereof, of material which does not wet, or react with, the binder alloy used to infiltrate the matrix material. For example, the formers may be formed from austenitic stainless steel which has a coefficient of thermal expansion significantly greater than that of the matrix. Consequently, as the matrix cools the formers, unlike graphite formers, are not subjected to substantial compressive stresses and, being formed from a material of greater dimensional stability than graphite, are not deformed to an extent as to cause serious variations in the dimensions of the sockets.

To inhibit reaction between the stainless steel of the formers and the binder alloy, each former may comprise a main body of stainless steel having a surface coating either in the form of a release agent, such as boron nitride, or in the form of a plated layer such as bronze or titanium nitride.

Each former may be provided with means to facilitate its removal from the finished bit body after infiltration. For example, the nozzle former 24 may be provided with an integral projecting rectangular end boss 33 for engagement by a spanner to permit the former 24 to be unscrewed from the bit body.

The former 21*a* is formed with an internally threaded blind bore into which a threaded portion of an extractor tool may be inserted and, similarly, the former 21*c* is provided with an internally threaded bore passing completely through the former.

The former 21*e* is formed with a projecting externally threaded boss for engagement by an internal thread on an extracting tool.

The former 21*d* is shown as an example of a former which tapers towards the interior of the mould space so as to produce a socket for engagement by a similarly tapered stud carrying a cutting element. The advantages that this may provide have been referred to earlier.

These former arrangements are shown by way of example only, and it is envisaged that, in practice, all the cutting structure formers will be similar.

As previously mentioned, use of formers according to the invention results in the sockets in the bit body being of smaller tolerances than are possible with graphite formers, thus facilitating shrink-fitting or press-fitting of the studs of the cutting structures in the bit body.

I claim:

1. A method of manufacturing by a powder metallurgy process a rotary drill bit including a bit body having an external surface on which are mounted a plurality of cutting elements, and a passage for supplying drilling fluid to the surface of the bit, the method including the steps of forming a rigid hollow mould for moulding at least a portion of the bit body, packing at least part of the mould with powdered matrix-forming material, and infiltrating the material with a metal alloy in a furnace to form a matrix, the method further including the step, before packing the mould with the powdered matrix-forming material, of positioning on the interior surface of the mould at least one former which projects into the interior of the mould space at the desired location for a socket within the bit body, the former being formed from material having a coefficient of thermal expansion not less than that of the matrix.

2. A method according to claim 1, wherein the former comprises a main body of material having a surface coating, the main body of material having a coefficient of thermal expansion not less than that of the matrix and the surface coating being of a material which does not wet, or react with, the binder alloy used to infiltrate the matrix-forming material.

3. A method according to claim 2, wherein the surface coating comprises a surface layer plated onto the main body of the former.

4. A method according to claim 3, wherein the main body of the former comprises stainless steel and the material of the surface layer plated on to the main body is selected from a copper-tin alloy or titanium nitride.

5. A method according to claim 3, wherein the materials of the surface layer and of the main body of the former are chosen such that the adherence of the surface coating material to the interior surface of the socket is greater than the adherence of the surface coating material to the main body of the former.

6. A method according to claim 5, wherein the surface coating material is a ceramic.

7. A method according to claim 6, wherein the surface coating material is boron nitride.

8. A method according to claim 1 wherein the former comprises stainless steel.

9. A method according to claim 8 wherein the former comprises austenitic stainless steel.

10. A method according to claim 1, wherein the former is provided with means for attachment of a tool whereby the former may be gripped to facilitate its removal from the finished bit body.

11. A method according to claim 10, wherein the former is provided with an internally threaded bore into which a threaded portion of an extraction tool may be inserted.

12. A method according to claim 10, wherein the former is provided with an extension which projects from the finished bit body and which may be gripped by a suitable tool.

13. A method according to claim 1, wherein the former is substantially cylindrical.

14. A method according to claim 1, wherein the former tapers towards the interior of the mould space.

15. A method according to claim 1, wherein the former is formed, at least at the outer surface thereof, of material which does not wet, or react with, the binder alloy used to infiltrate the matrix-forming material.

* * * * *

UNITED STATES PATENT AND TRADEMARK OFFICE

CERTIFICATE OF CORRECTION

PATENT NO. : 4,720,371

DATED : January 19, 1988

INVENTOR(S) : David Shirley

It is certified that error appears in the above-identified patent and that said Letters Patent is hereby corrected as shown below:

In Column 7, line 1, delete "5" and insert therefor --2--.

Signed and Sealed this

Twenty-fourth Day of May, 1988

*Attest:*

*Attesting Officer*

DONALD J. QUIGG

*Commissioner of Patents and Trademarks*